US009784067B2

(12) United States Patent
Moffitt

(10) Patent No.: US 9,784,067 B2
(45) **Date of Patent: *Oct. 10, 2017**

(54) LINER CEMENTATION PROCESS AND SYSTEM

(71) Applicant: Schlumberger Technology Corporation, Sugar Land, TX (US)

(72) Inventor: Michael E. Moffitt, Kingwood, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 235 days.

This patent is subject to a terminal disclaimer.

(21) Appl. No.: 14/535,672

(22) Filed: Nov. 7, 2014

(65) Prior Publication Data

US 2015/0060071 A1 Mar. 5, 2015

Related U.S. Application Data

(63) Continuation of application No. 13/461,342, filed on May 1, 2012, now Pat. No. 8,881,814.

(Continued)

(51) Int. Cl.

| | |
|---|---|
| ***E21B 33/14*** | (2006.01) |
| ***E21B 43/10*** | (2006.01) |
| ***E21B 7/20*** | (2006.01) |

(52) U.S. Cl.

CPC ..... *E21B 33/14* (2013.01); *E21B 7/20* (2013.01); *E21B 43/10* (2013.01)

(58) Field of Classification Search

CPC ..... E21B 33/13; E21B 7/20; E21B 43/10

See application file for complete search history.

(56) References Cited

U.S. PATENT DOCUMENTS

| | | | |
|---|---|---|---|
| 4,854,386 | A | 8/1989 | Baker et al. |
| 4,942,924 | A | 7/1990 | Duncan |

(Continued)

FOREIGN PATENT DOCUMENTS

| | | | |
|---|---|---|---|
| GB | 2214951 | A | 9/1989 |

OTHER PUBLICATIONS

International Search Report and Written Opinion issued Apr. 5, 2013 in corresponding International Application No. PCT/US2012/036159 (15 pages).

(Continued)

*Primary Examiner* — David Bagnell
*Assistant Examiner* — Manuel C Portocarrero

(57) ABSTRACT

Present embodiments are directed to coupling a cementation assembly with a hung or set liner string in a well and moving the liner string during a cementation operation. Specifically, for example, a process in accordance with present techniques includes running a cementation assembly into a well on drill pipe and engaging, with a distal end of the cementation assembly, a liner top assembly of a liner string that is positioned downhole in the well, wherein the liner string was previously positioned downhole in the well without being cemented into the well. Further, the process includes latching the cementation assembly with the liner string such that movement of the cementation assembly is translated to the liner string, and flowing cement through the drill pipe and into the liner string while moving the cementation assembly and the liner string.

17 Claims, 6 Drawing Sheets

Related U.S. Application Data

(60) Provisional application No. 61/481,564, filed on May 2, 2011.

(56) References Cited

U.S. PATENT DOCUMENTS

| | | | | |
|---|---|---|---|---|
| 7,784,552 | B2 * | 8/2010 | Brouse | E21B 7/20 166/285 |
| 7,798,251 | B2 | 9/2010 | Eriksen et al. | |
| 8,881,814 | B2 * | 11/2014 | Moffitt | E21B 33/14 166/177.4 |
| 2004/0194954 | A1 * | 10/2004 | Cram | E21B 23/04 166/208 |
| 2009/0090508 | A1 | 4/2009 | Brouse | |
| 2009/0107675 | A1 * | 4/2009 | Eriksen | E21B 7/20 166/285 |
| 2011/0203794 | A1 | 8/2011 | Moffitt et al. | |
| 2012/0222861 | A1 | 9/2012 | Eriksen | |

OTHER PUBLICATIONS

First Office Action issued May 27, 2015 in corresponding Chinese application No. 201280032926.8 (w/translation) (23 pages).

Communication pursuant to Article 94(3) EPC issued Apr. 15, 2015 in corresponding European application No. 12 722 976.3 (7 pages).

International Search Report and Written Opinion dated Apr. 5, 2013 in corresponding International Application No. PCT/US2012/036159 (15 pages).

T. Jackson et al: "Development of an Expandable Drill-In Liner Hanger for Use in Problem-Well Scenarios: Case History", Proceedings of Offshore Technology Conference, Jan. 1, 2006 (11 pages).

"Liner Hanger Selection—A Guide for Drilling and Completion Engineers"; May 1, 2006 (22 pages).

Tesco Casing Drilling, Tesco Corporation, Apr. 2008, 12 pgs.

* cited by examiner

LINER CEMENTATION PROCESS AND SYSTEM

CROSS-REFERENCE TO RELATED APPLICATION

This application is a continuation application, and claims benefit pursuant to 35 U.S.C. §120 of U.S. patent application Ser. No. 13/461,342, filed on May 1, 2012, now U.S. Pat. No. 8,881,814, which is incorporated by reference in its entirety, which claims priority under 35 U.S.C. §119 to U.S. Provisional Patent Application Ser. No. 61/481,564, entitled "Liner Cementation Process and System," filed May 2, 2011, which is hereby incorporated by reference in its entirety.

FIELD OF DISCLOSURE

The present disclosure relates generally to the field of cementation of a liner string within a wellbore. More specifically, embodiments of the present disclosure relate to methods and equipment utilized to cement a liner string in a wellbore when the liner string is installed downhole while drilling.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is properly positioned within a hole or well, the casing is typically cemented in place by pumping cement through the casing and into an annulus formed between the casing and the hole (e.g., a wellbore or parent casing). The cement may fill all or a portion of the casing such that an initial amount of cement is forced, by the accumulated head of cement and/or pumping pressure, out of the bottom of the casing and up along the outside diameter of the casing such that the cement passes into the annulus between the casing and the hole. It then becomes desirable to push substantially all of the cement out of the casing and further into the annulus to cement the casing in place. Accordingly, once a sufficient amount of cement has been poured into the casing, the cement may be forced out of the interior of the casing and into the annulus by pushing a plug through the casing with pressurized displacement fluid.

Once a easing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper that the previously installed casing or parent casing string.

Liner may also be employed in some drilling operations. Liner may be defined as a string of pipe or tubular that is used to case open hole below existing casing. Casing is generally considered to extend all the way back to a wellhead assembly at the surface. In contrast, a liner merely extends a certain distance (e.g., 30 meters) into the previously installed casing or parent casing string. However, a tieback string of casing may be installed that extends from the wellhead downward into engagement with previously installed liner. The liner is typically secured to the parent casing string by a liner hanger that is coupled to the liner and engages with the interior of the upper casing or liner. The liner hanger may include a slip device (e.g., a device with teeth or other gripping features) that engages the interior of the upper casing string to hold the liner in place. It should be noted that, in some operations, a liner may extend from a previously installed liner or parent liner.

Again, the distinction between casing and liner is that casing generally extends all the way to the wellhead and liner only extends to a parent casing or liner. Accordingly, the terms "casing" and "liner" may be used interchangeably in the present disclosure. Indeed, liner is essentially made up of similar components (e.g., strings of tubular structures) as casing. Further, as with casing, a liner is typically cemented into the well. A cementation assembly is typically employed at the end of a pipe string to facilitate cementation of a liner. Traditional cementation assemblies sting into the top of a liner and enable injection of cement into the liner from the surface via the pipe string. As with the cementation of the casing discussed above, the cement may be forced through the liner such that it exits a bottom of the liner and fills the annulus between the liner and the hole. Thus, the liner may be cemented into the well.

It is now recognized that existing techniques for the cementation of liners into wells may result in a lack of consistency in the cement disposed in the annulus formed by the liner and the well. Accordingly, it is now recognized that improved techniques and equipment for cementing liners into wells are desirable.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present disclosure relates generally to methods and equipment for cementing a liner string within a wellbore. More specifically, embodiments of the present disclosure are directed to maneuvering a previously hung liner string during a cementation process for cementing the liner string into the well. The ability to maneuver the liner string during cementation may be achieved by running a cementation assembly into the well on a drill string, and coupling the cementation assembly with an upper end of the liner string such that movement of the drill string will be translated to the liner string via the cementation assembly. Thus, the coupled cementation assembly and liner string can be rotated and/or reciprocated by rotating and/or reciprocating the drill string with drilling equipment.

Further, present embodiments may continually or periodically move the liner string while cement is passed through the cementation assembly, into the liner string, out of a bottom (e.g., a liner shoe) of the liner string, and up into an annulus formed between the outside of the liner string and the wellbore, wherein the wellbore may include parent casing. This movement of the liner string during cementation may facilitate distribution of the cement in the annulus between the liner string and the wellbore. It is now recognized that when a liner string is simply held in place during cementation, gaps or inconsistencies in the cement can form because the liner string may be closer to the wellbore in certain locations or the annulus between the liner string and wellbore may be obstructed such that cement flows around such obstructions and leaves pockets. By rotating and reciprocating the liner string during cementation, the liner string may facilitate circulation of the cement into areas that would otherwise form gaps and remove potential obstructions to more consistent cement flow.

Figure 1:
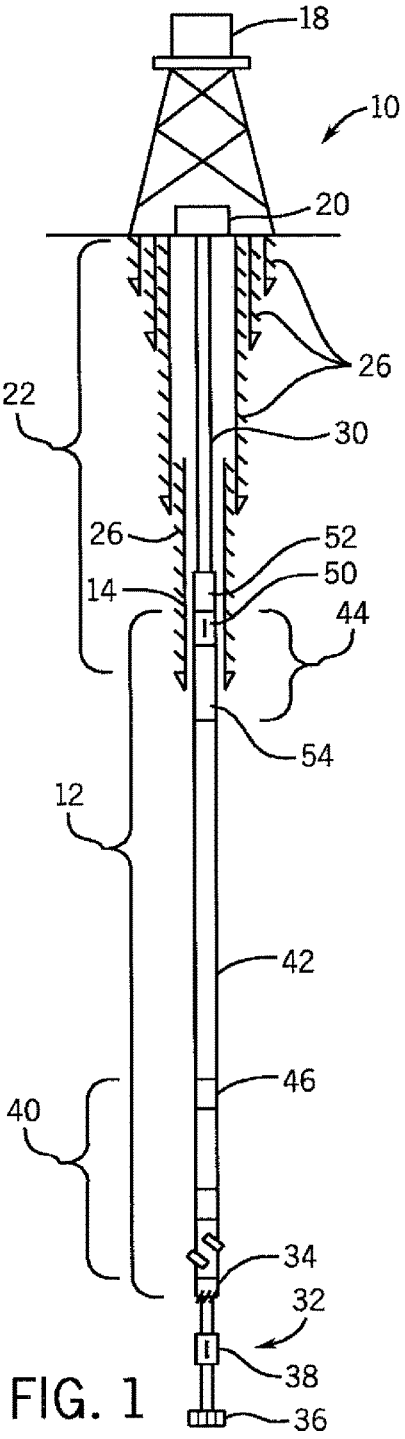
FIG. 1 is a schematic representation of a well being drilled in accordance with present techniques.

Turning to the figures, FIG. 1 is a schematic representation of a well 10 that is being drilled using a casing-while-drilling technique, wherein a liner string 12 is about to be hung within a previously installed liner 14 that was cemented into the well 10 in accordance with present techniques. In other embodiments, different drilling techniques may be employed. The well 10 includes a derrick 18, wellhead equipment 20, and several levels of casing 22 (e.g., conductor pipe, surface pipe, intermediate string), which includes the previously installed liner 14, which may be casing in some embodiments. The casing 22 and the liner 14 have been cemented into the well 10 with cement 26. The liner 14 has been cemented into the well 10 using techniques in accordance with the present disclosure. Further, as illustrated in FIG. 1, the liner string 12 is in the process of being hung from the previously installed liner 14, which may be referred to as the parent liner 14.

While other embodiments may utilized different drilling techniques, as indicated above, the well 10 is being drilled using a easing-while-drilling technique. Specifically, the liner string 12 is being run as part of the drilling process. In the illustrated embodiment, a drill pipe 30 is coupled with the liner string 12 and a drilling BHA 32. The drilling BHA 32 is also coupled with an upper portion of the liner string 12 and extends through the liner string 12 such that certain features of the drilling BHA 32 extend out of the bottom of the liner string 12. Indeed, an upper portion of the drilling BHA 32 is disposed within the inside diameter of the liner string 12, while a lower portion of the drilling BHA 32 extends out of a liner shoe 34 at the bottom of the liner string 12. Specifically, in the illustrated embodiment, a drill bit 36 and an under reamer 38 of the drilling BHA 32 extend out from the liner string 12. Thus, the drilling BHA 32 is positioned to initiate and guide the drilling process.

The liner string 12 includes a shoe track 40, a string of tubing 42, and a liner top assembly 44. The shoe track 40 defines the bottom of the liner string 12 and includes the liner shoe 34 to facilitate guiding the liner string 12 through the wellbore. In the illustrated embodiment, the shoe track 40 also includes an indicator landing sub 46 to facilitate proper engagement with the drilling BHA 32, and various other features, such as a pump down displacement plug (PDDP), that will be discussed in further detail below. The string of tubing 42 is essentially the main body of the liner string 12 that connects the shoe track 40 with the liner top assembly 44. The liner top assembly 44, which defines the top of the liner string 12, includes a liner hanger 50 that is capable of being activated and/or deactivated by a liner hanger control tool 52. The liner top assembly 44 may also include a liner drill lock section 54, which includes a liner drill lock that facilitates engagement/disengagement of the drill string 30 from the liner string 12. The liner drill lock may be actuated by external or internal components affixed to or part of a body of the liner hanger 50.

Once a desired depth is reached, the liner string 12 may be hung or set down to facilitate detachment of the drilling BHA 32. As illustrated in FIG. 1, the liner string 12 may be hung from the parent casing 14, and the drilling BHA 32 may be detached from the liner string 12 and pulled out of the well 10 with the drill string 30 and an inner string (not shown). In order to hang the liner string 12 from the parent casing 14, the hanger 50 may be activated with the liner hanger control tool 52. In some embodiments, the hanger 50 is not utilized and the liner string 12 is set on bottom.

Figure 2:
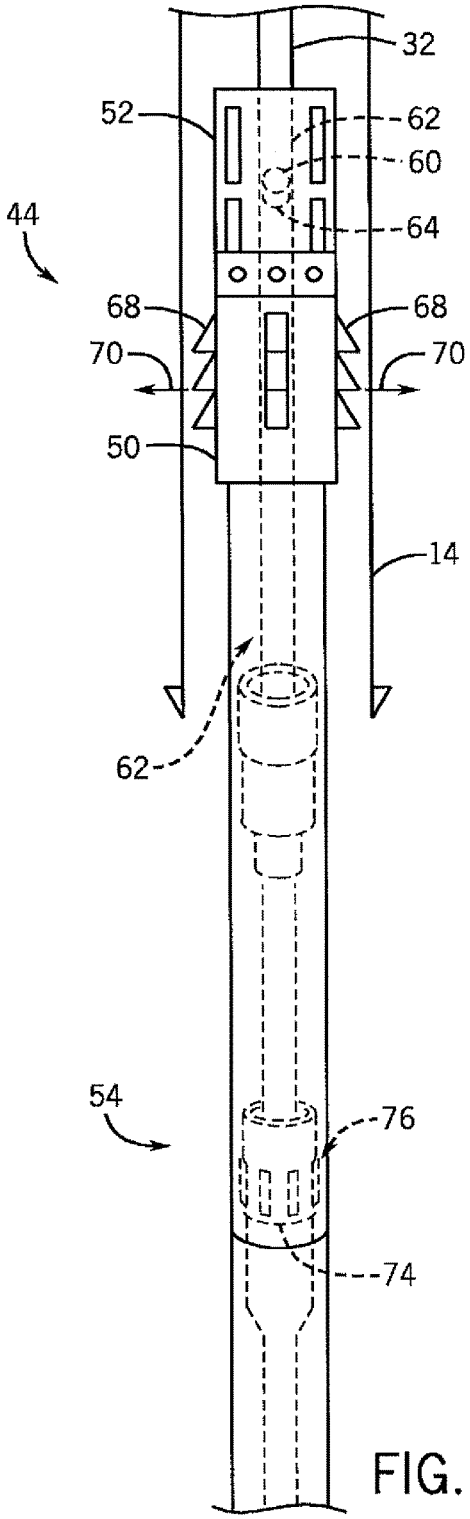
FIG. 2 is a schematic representation of a liner top assembly in accordance with present techniques.

FIG. 2, which is a detailed view of the liner top assembly 44 of FIG. 1, illustrates features that may be utilized during hanging the liner hanger 50 in accordance with present embodiments. Specifically, as illustrated in FIG. 2, a ball 60 may be dropped, circulated or pushed through the drill string 32, into an inner string or running tool component 62 of the liner top assembly 44, and into engagement with a ball seat 64 disposed within the liner hanger control tool 52. This may block fluid flow and enable pressurization of the liner hanger control tool 52 by pumping in fluid via the drill string 32. The increase in pressure will stroke the liner hanger control tool 52 to set the liner hanger 50. That is, the liner hanger control tool 52 is activated by increasing pressure, which causes gripping features 68 of the liner hanger 50 to extend outward from the liner hanger 50 and engage the interior of the parent casing 14, as illustrated by arrows 70 in FIG. 2. In other embodiments, different techniques for activation of the liner hanger 50 may be utilized. For example, the liner hanger 50 may include a male component that expands into a female receptacle of the parent casing 14. Once the liner hanger 50 is activated and the gripping features 68 are properly engaged, the weight of the liner string 12 may be placed fully on the liner hanger 50.

Figure 3:
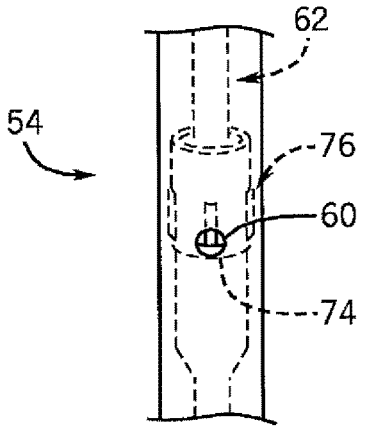
FIG. 3 is a detailed schematic view of a liner drill lock section of the liner top assembly of FIG. 2.

After the liner hanger 50 is properly engaged, additional pressure may be added to fluid above the ball 60 until the ball seat 64 is sheared and the ball 60 falls further through the running tool 62 of the liner top assembly 44, and into engagement with a ball seat 74 of a liner drill lock 76 in the liner drill lock section 54. This engagement between the ball 60 and the ball seat 64 of the liner drill locks section 54 is illustrated in FIG. 3, which is a detailed representation of the liner drill lock section 54 of FIG. 2. As with the liner hanger control tool 52, pressure can now be increased at the liner drill lock 76 because the ball 60 is blocking fluid flow. Increasing the pressure will cause the liner drill lock 76 to release the drill string 30 from the liner string 12 by disengaging a coupling between the running tool 62 and the liner string 12. Once released, the drill string 30, which remains attached to the liner hanger control tool 52, may be pulled from the well 10. The drilling BHA 32, which remains attached to the drill string 30, will be pulled through the liner string 12, out of the liner top assembly 44, and out of the well 10. Thus, the liner string 12 is hung in the parent casing 14, the drilling BHA 32 is removed, and the liner string 12 is ready for cementing.

Figure 4:
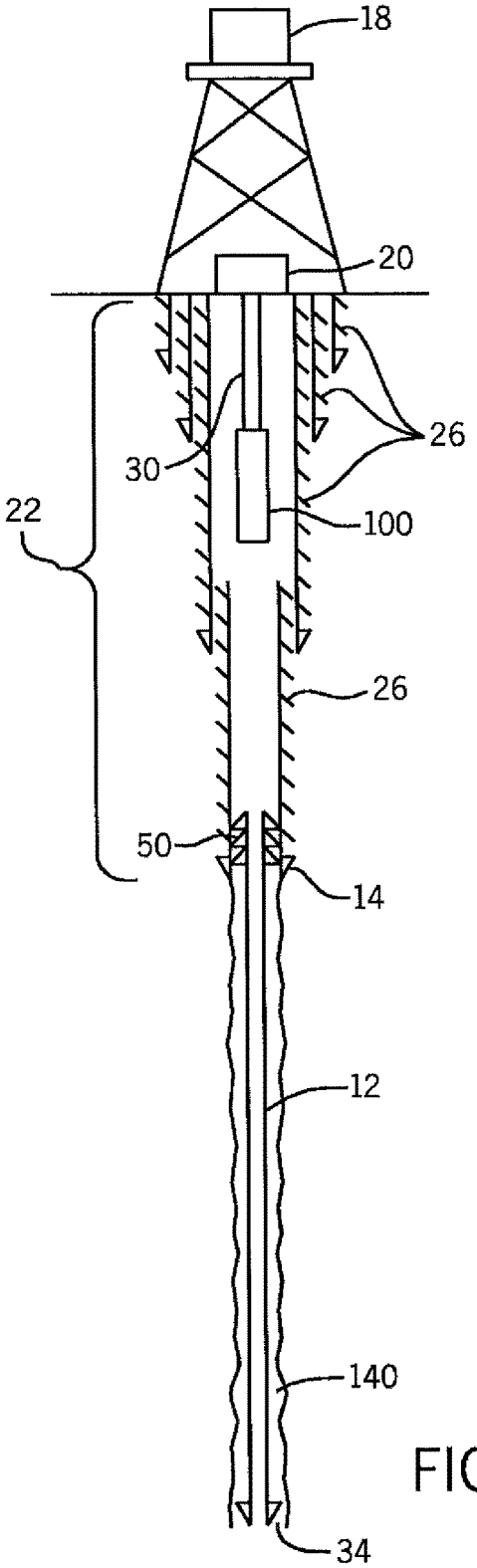
FIG. 4 is a schematic representation of a well during a cementation process in accordance with present techniques.
Figure 5:
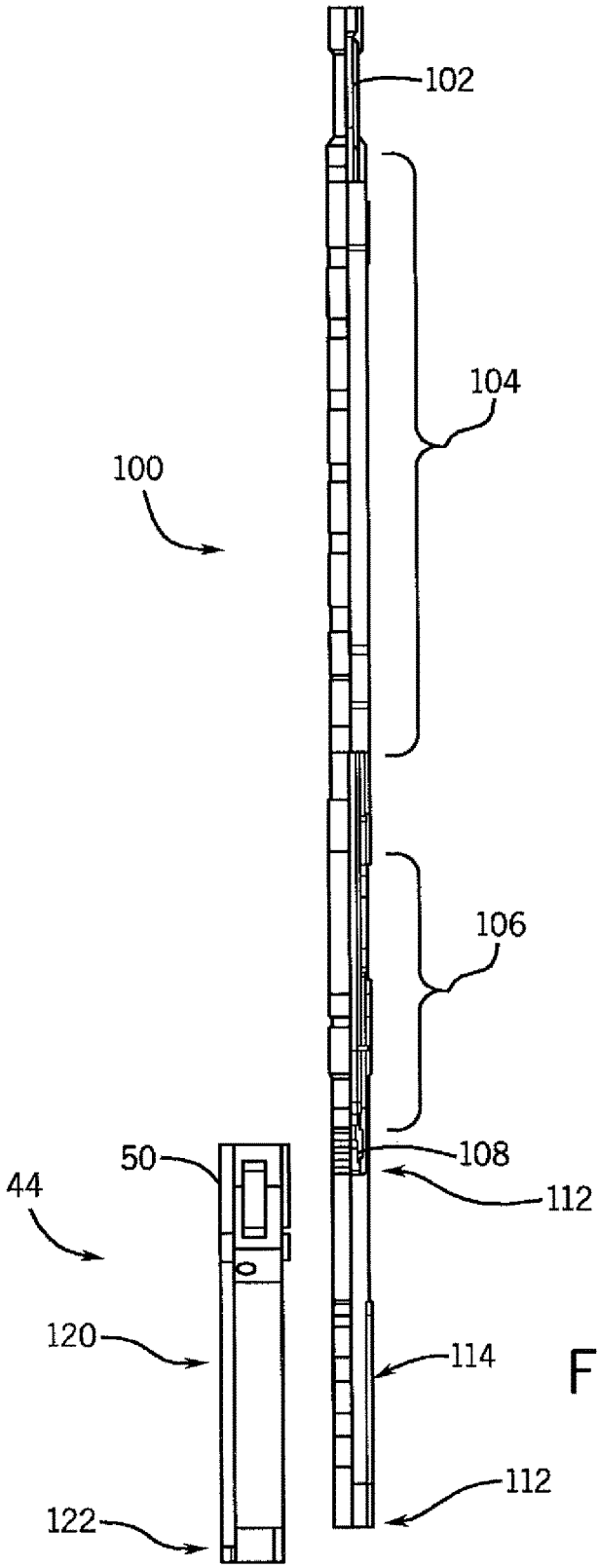
FIG. 5 is a side view of a cementation assembly that is partially cross-sectioned and an upper portion of a previously set liner string in accordance with present techniques.

FIG. 4 is a schematic diagram of the well 10 with the liner string 12 hung from the parent liner 14 via the liner hanger 50, wherein the drilling BHA 32 has been extracted and a cementation assembly 100 is being lowered into the well 10 via the drill string 30 to facilitate cementation of the liner string 12 into the well 10 in accordance with present embodiments. FIG. 5 illustrates a side view of the cementation assembly 100 that is partially cross-sectioned and a side view of a portion of the liner top assembly 44 in accordance with present embodiments. As illustrated in FIG. 5, one embodiment of the cementation assembly 100 includes a running tool 102, an expandable liner top packer 104, a two-way float valve or drillable cement valve 106, a liner wiper plug (LWP) or PDDP 108 coupled to a distal end of the running tool 102, a spacer joint 110, latching features 112, and a tie back seal stem (TBSS) or seal nipple 114. It should be noted that the latching features 112 may be positioned in one or both of the locations indicated in FIG. 5 in accordance with present embodiments. Further, the latching features may include mechanical and/or hydraulic components. The liner top assembly 44 includes the liner hanger 50, a polished bore receptacle (PBR) 120, and a casing profile nipple (CPN) 122. The latching features may couple with components of the liner hanger 50, PBR 120, and/or CPN 122.

Figure 6:
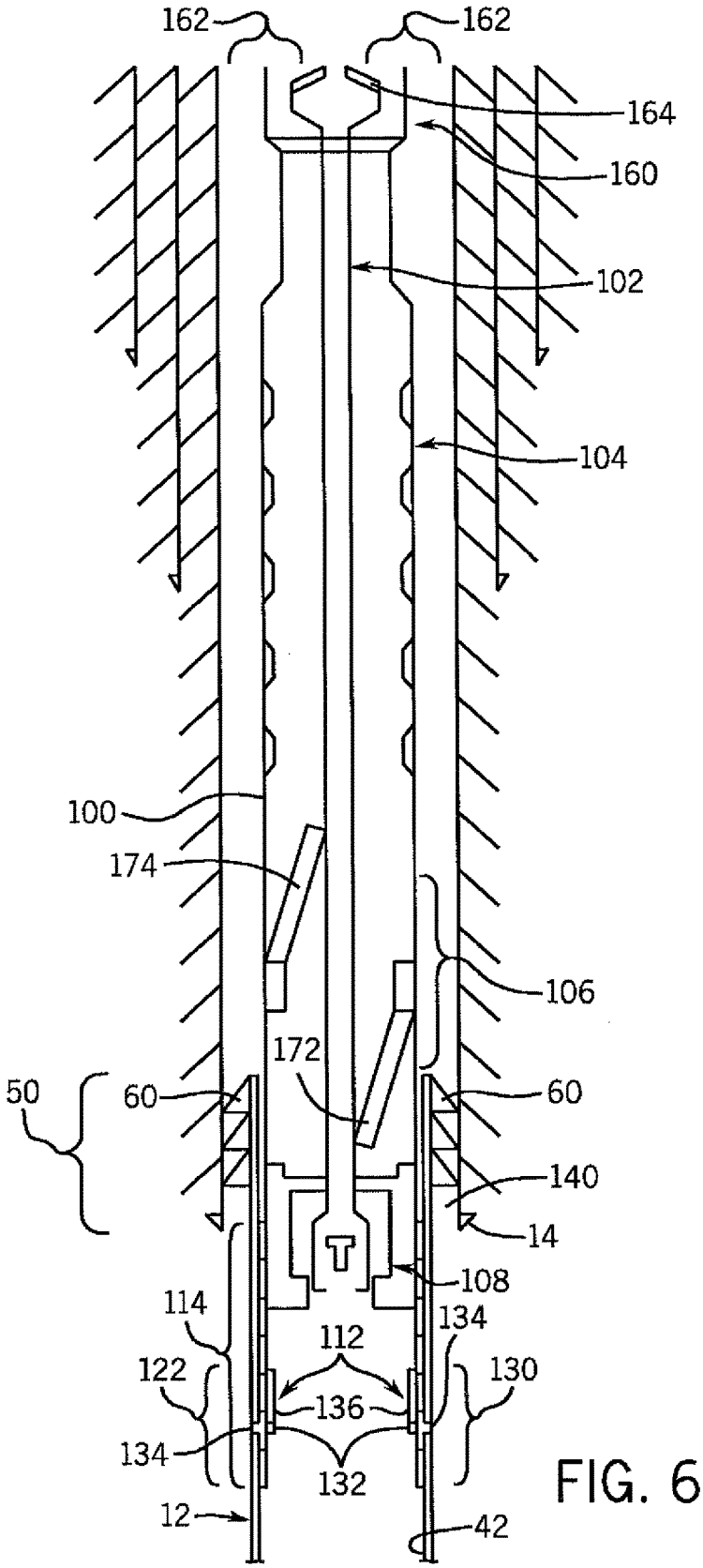
FIG. 6 is a schematic representation of the cementation assembly and liner string of FIG. 5.

FIG. 6 illustrates a schematic view of the cementation assembly 100 in accordance with present embodiments, wherein in the cementation assembly 100 is in the process of engaging the liner string 12, which was previously hung without being cemented into the well 10. As illustrated in FIG. 6, the cementation assembly 100 may include the running tool 102, the expandable liner top packer 104, the drillable cement valve 106, the liner wiper plug 108, one set of the latching features 112, and the TBSS 114. The liner string 12 includes the hanger 50, the PBR 120, the CPN 122, and the casing 42. In other embodiments, the cementation assembly 100 may include different features. For example, the cementation assembly 100 may not include the drillable cement valve 106, the liner wiper plug 108, or the set of latching features 112.

Specifically, the embodiment illustrated in FIG. 6 includes the latching features 112 located on a shoe 130 of the TBSS 114. The latching features 112 are configured to latch into the CPN 122 of the liner string 12. Specifically, the latching features 112 include a set of dogs 132 that are configured to move outwardly to engage recesses 134 in the CPN 122 and a sliding liner, inner sheath, or tubing segment 136 configured to slide down when the dogs 132 engage the recesses 134 to hold the dogs 132 in engagement by preventing the dogs 132 from reversing or moving inwardly. The latching features 112 may be activated mechanically or hydraulically. For example, a shearing mechanism may be employed. In other embodiments, different types of latching features 112 may be employed. Indeed, in one embodiment, the latching features 112 are located on the cementation assembly 100 slightly downhole of the expandable liner top packer 104 and are configured to latch into the hanger 50 of the liner string 12. Regardless, the latching features 112 are configured to engage and couple with the liner string 12 such that movement of the cementation assembly 100 is translated to the liner string 12. Once the cementation assembly 100 and the liner string 12 are latched together, the cementation assembly 100 may be moved such that the liner string 12 moves correspondingly and such that the liner hanger 50 becomes disengaged from the parent casing 14 as a result. Specifically, for example, the cementation assembly 100 may be lifted up such that the gripping features 60 of the liner hanger 50 become disengaged from the parent casing 14. This generally results in essentially permanently disabling the liner hanger 50. Indeed, in some embodiments, a control device may be employed to ensure permanent retraction of the gripping features 60. Disengaging the liner hanger 50 enables rotation and/or reciprocation of the liner string 12 via the cementation assembly 100.

Once the cementation assembly 100 and the liner string 12 are properly engaged (e.g., the TBSS 114 is engaged with the PBR 120), circulation can be established through the drill pipe 32 to the inside of the liner string 12 via the cementation assembly 100. Indeed present embodiments facilitate flowing cement into the liner string 12 and out of a bottom of the liner string 12 or out of the liner shoe 34 such that the cement fills an annulus 140 between the wellbore and the liner string 12. Thus, the liner string 12 is cemented into the well 10. During the cementation process (e.g., while cement is flowing into the liner string 12 and/or the annulus 140), the cementation assembly 100 may be maneuvered to facilitate cementation. Indeed, the drill pipe 30 may be moved via the surface equipment 20 such that the cementation assembly 100 moves and translates movement to the liner string 12. Specifically, the cementation assembly 100 may be rotated and/or reciprocated such that these movements are translated to the liner string 12 via the latching features 112. This rotation and/or reciprocation of the liner string 12 may cause the cement to be distributed around the annulus 140 and the removal blockages or engulfment of blockages by the cement. In some embodiments, such rotation and/or reciprocation is performed while cement is flowing. In other embodiments, the rotation and/or reciprocation is performed when there is no cement flowing (e.g., during curing). In still other embodiments, the rotation and/or reciprocation is performed during both flowing the cement and after a desired amount of cementation has been performed.

Figure 7:
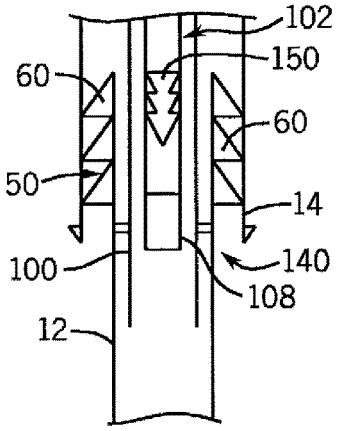
FIG. 7 is a schematic representation of a drill pipe dart passing through the cementation assembly of FIG. 6.
Figure 8:
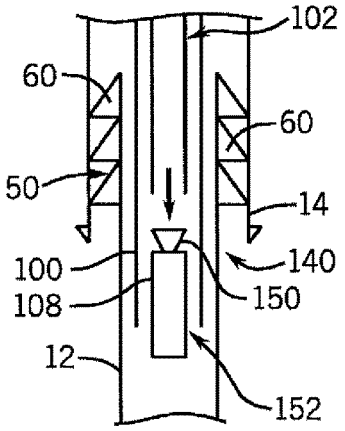
FIG. 8 is a schematic representation of the drill pipe dart engaged with the liner wiper plug and disengaged from the running tool of FIG. 6.
Figure 9:
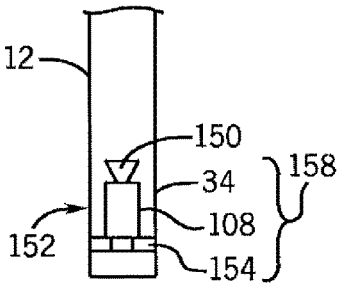
FIG. 9 is a schematic representation of the drill pipe dart assembled with the liner wiper plug and engaged with the liner string to form an isolation mechanism in accordance with present techniques.

After a desired quantity of cement is pumped through the drill pipe 30 and the cementation assembly 100 for the purpose of cementing the liner string 12 into the well 10, the cement is followed by a drill pipe dart (DPD) 150, as illustrated in the schematic representation provided in FIG. 7. The DPD 150 is propelled by a displacement fluid through the drill pipe 30 and the running tool 102 such that all cement within these features is wiped and pushed downhole. The DPD 150 eventually lands and latches into the LWP 108. The DPD 150 and LWP 108 attach and combine to form a DPD/LWP assembly 152, as illustrated by the schematic representation in FIG. 8. The DPD/LWP 152 assembly then detaches from the running tool 102 (e.g., because of pressure buildup) and passes through the liner string 12, wiping the cement from inside the liner string 12 and pushing it into the annulus 140. Eventually, the DPD/LWP assembly 152 lands in or engages a capture feature 154 (e.g., a profile nipple) of the liner string 12, as illustrated in FIG. 9. The downhole progression of the DPD/LWP assembly 152 is thus halted. Engaging the DPD/LWP assembly 152 with the capture feature 154 forms an isolation mechanism 158 that can be utilized to increase pressure within the liner string 12 and the cementation assembly 100. Indeed, pressure can be increased by pushing fluid against the isolation mechanism 158 such that the increased pressure activates the expandable liner top packer 104 until it engages the parent casing 14. Thus, the expandable liner top packer 104 is enabled to function as a liner hanger for the assembled liner string 12 and cementation assembly 100. It should be noted that, in some embodiments, the LWP 108 is not utilized. For example, a cement retainer may be run on an inner string mounted to the bottom of the running tool 102 instead of the LWP 108. In such an embodiment, the cement is pumped and followed by the DPD 150, which lands in the retainer to form an isolation mechanism that can be used to pressure up upon to expand the expandable liner top packer 104.

Figure 10:
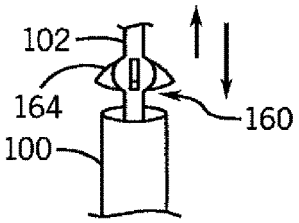
FIG. 10 is a schematic representation of a packer setting device being employed to set a packer in accordance with present techniques.

The expandable liner top packer 104 may be functioned mechanically and/or hydraulically in accordance with present embodiments. In one embodiment, pressure or mechanical actuation activates an expansion mechanism of the running tool 102 and the liner top packer 104 is correspondingly expanded to engage the parent casing 14. For example, pressure may be used to activate an expansion tool such that it is conveyed along the running tool 102 and through the expandable liner top packer 104. An outside diameter of the expansion tool (e.g., an expansion mandrel) is larger than the inside diameter of the expandable liner top packer 104. Thus, as the expansion tool traverses the bore of the expandable liner top packer 104, the expandable liner top packer is caused to expand into the parent casing 14. That is, the expandable liner to packer 104 is permanently deformed into the parent casing 14. The running tool 102 remains engaged until the expandable liner top packer 104 is expanded. Once the liner top packer 104 is expanded, the liner weight is placed on the expanded liner top packer 104, and the running tool 102 is decoupled. In one embodiment, to facilitate engagement or positioning of the liner top packer 104, the cementation assembly 100 includes a packer setting device 160. As illustrated in FIG. 6, the packer setting device 160 may be a component of the running tool 102. To utilize the packer setting device 160, the running tool 102 and drill pipe 30 may be disengaged from outer features 162 of the cementation assembly 100. Next, the packer setting device 160 may be repositioned uphole relative to the outer features 162 of the cementation assembly 100 such that packer setting dogs 164 are activated and expand outwardly to facilitate engagement of the upper portion of the cementation assembly 100 (e.g., the outer features 162 near the expandable liner top packer 104), as illustrated by the schematic representation in FIG. 10. The activated packer setting device 160 may then be set down such that it engages the cementation assembly 100. A set down weight applied to the cementation assembly 100 via the packer setting device 160 may then be used to set or manipulate aspects of the expandable liner top packer 104 after it has been expanded.

FIG. 6 also illustrates the drillable cement valve 106 as including an upward-facing flapper valve 172 and a downward-facing flapper valve 174. In some embodiments, a plurality of such valves may be utilized in the drillable cement valve 106. For example, two of the upward-facing flapper valves 172 and two of the downward-facing flapper valves 174 may be employed in accordance with present embodiments to facilitate testing and/or circulation of excess cement off the liner top assembly 44. The flapper valves 172, 174 are biased toward a closed position but are blocked open by the running tool 102 while it remains in the drillable cement valve 106. However, removal of the running tool 102 will allow the flapper valves 172,174 to close. These flapper valves may be 172, 174 utilized to address potential issues with backflow and testing. Indeed, once the cement is positioned within the annulus 140, an imbalance between the cement and displacement fluid may allow the cement to flow back into the liner string 12. Further, it may be desirable to test the expandable liner top packer 104, and pressures associated with such testing can cause further displacement of the DPD/LWP assembly 152. By providing pressure isolation in both directions, the combined flapper valves 172, 174 of the drillable cement valve 106 address these issues.

Figure 11A:
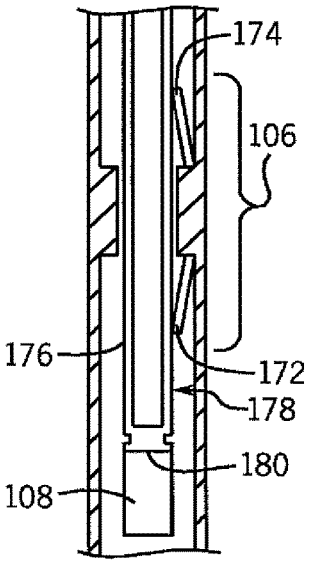
FIG. 11A is a schematic representation of a two-way float valve that is propped open by a running tool in accordance with present techniques.
Figure 11B:
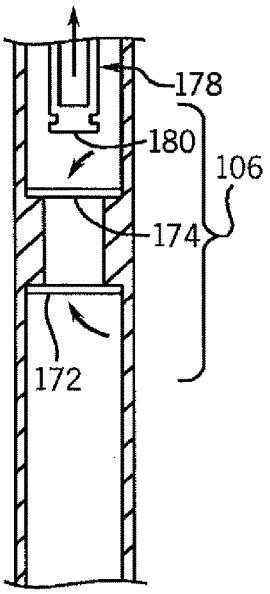
FIG. 11B is a schematic representation of the two-way float valve in a closed position with the running tool having been removed in accordance with present techniques.

In one embodiment, the drillable cement valve 106 is constructed of a composite or a cement insert solidly mounted or sealed to a pup joint inside diameter between the expandable liner top packer 104 and the TBSS 114. The drillable cement valve 106 includes at least one of the upward-facing flapper valves 172 and at least one of the downward-facing flapper valves 174. A pick-up tube 176 (e.g., a portion of the running tool 102) may be positioned to hold the flapper valves 172, 174 open, as illustrated in the schematic representation in FIG. 11A. The LWP 108 may initially be mounted to the pick-up tube 176. Once the expandable liner top packer 104 has been properly set and the LWP 108 has been launched, the running tool 102 may be repositioned to allow the flapper valves 172, 174 to close, as illustrated by the schematic representation in FIG. 11B. Specifically, once the running tool 102 is disengaged from the cementation assembly 100, the drill pipe 30 may be lifted up such that a slick stinger 178 and LWP launch nipple 180 (i.e., the distal end of the running tool 102 without the LWP 108 attached) of the running tool 102 are removed from engagement with the drillable cement valve 106 and the flapper valves 172, 174 close. In some embodiments, a profile on the launch nipple 180 engages the pick-up tube 176 and pulls it from the drillable cement valve 106 such that the flapper valves 172, 174 close to provide pressure isolation from both directions. This results in protection from flow of the cement back into the liner string 12 and accidental displacement of the DPD/LWP assembly 152.

The running tool 102 may repositioned such that excess cement near the top of liner top packer 104 may be reversed to the surface via the running tool 102. Further, the running tool 102 may be completely extracted from the remaining components of the cementation assembly 100 and removed from the well 10. Once the running tool 102 has been removed, the well 10 may be in condition for additional drilling or other operations. Indeed, the remaining portions of the cementation assembly 100 are now cemented along with the liner string 12 into the wellbore.

Figure 12:
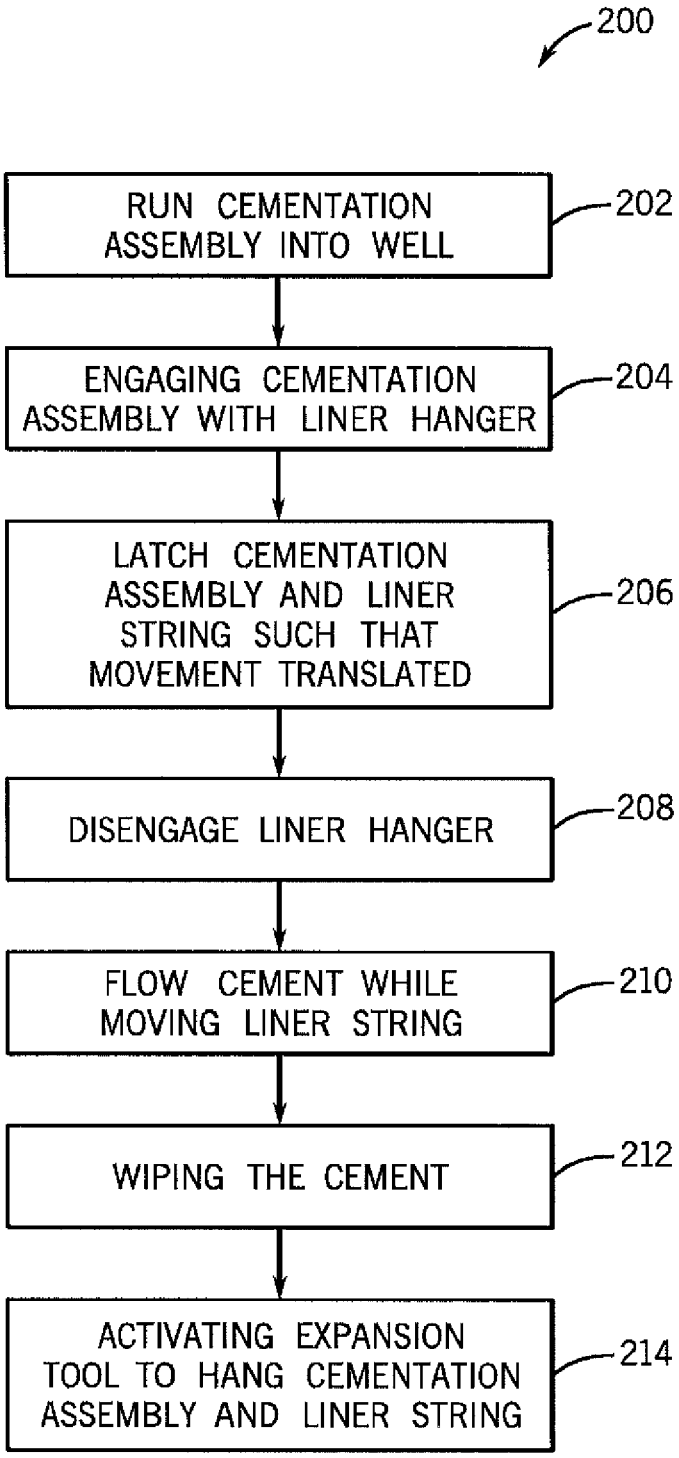
FIG. 12 is a process flow diagram of a method in accordance with present techniques.

FIG. 12 illustrates a method 200 in accordance with embodiments of the present disclosure. The method 200 includes running a cementation assembly into a well, which may be done on drill pipe, as represented by block 202. Further, the method includes engaging a distal end of the cementation assembly with a liner top of a liner string (e.g., passing an end of the cementation assembly through the inside diameter of the liner hanger), as represented by block 204. The liner string was previously positioned downhole in the well without being cemented into the well. Further, as represented by block 206, the method includes latching the cementation assembly with the liner string such that movement of the cementation assembly is translated to the liner string. This may be achieved with one or more latching features that utilize mechanical and/or hydraulic latching components. The cementation assembly and the liner string are then maneuvered (e.g., pulled up) such that the liner hanger is disengaged from the parent casing, as illustrated by block 208. Next, as represented by block 210, cement is pumped into the liner string (e.g., via the drill pipe and the cementation assembly). The cement will eventually pass into an annulus between the liner string and the wellbore. The action represented by block 210 may include moving (e.g., reciprocating and/or rotating) the cementation assembly and the liner string while flowing the cement. Block 212 represents wiping the cement from the liner and/or drill string. Specifically, this may include passing a drill pipe dart (DPD) through the drill pipe into engagement with a liner wiper plug (LWP) of the cementation assembly such that the DPD and LWP form a DPD/LWP assembly, and passing the DPD/LWP assembly through the liner string. Block 214 represents activating an expansion tool of the cementation assembly to hang the cementation assembly and the liner. This may include engaging a capture feature of the liner string with the DPD/LWP assembly such that an isolation mechanism is established, and pressurizing the cementation assembly by pressuring against the isolation mechanism such that a liner hanger expansion tool of the cementation assembly is activated by the pressure and hangs the cementation assembly and the liner string within the parent casing.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A process, comprising:

running a cementation assembly into a well on drill pipe;

engaging, with a distal end of the cementation assembly, a liner top assembly of a liner string that is downhole in the well, wherein the liner string was previously positioned downhole in the well without being cemented into the well;

latching the cementation assembly with the liner string such that rotational and reciprocal movement of the cementation assembly is translated to the liner string, wherein latching the cementation assembly with the liner string includes activating a latch after passing the latch through a liner hanger of the liner top assembly;

flowing cement through the drill pipe and into the liner string; and moving the cementation assembly and the liner string during the flowing of cement.

2. The process or claim 1, wherein the rotational and reciprocal movement of the cementation assembly and the liner string occurs while flowing cement through the drill pipe.

3. The process of claim 1, comprising maneuvering the cementation assembly and the liner string to disengage the liner hanger of the liner string from a parent casing.

4. The process of claim 1, comprising positioning the liner string downhole during a casing-while-drilling procedure, activating the liner hanger such that the liner string is held in place and coupled to a parent casing, and removing a bottom hole assembly from the well.

5. The process of claim 1, wherein latch is a mechanically activated latch or a hydraulically activated latch.

6. The process of claim 1, wherein activating the latch on the cementation assembly includes engaging a profile sub separate from the liner hanger.

7. A cementation system, comprising:

a cementation assembly, comprising:

an expandable liner top packer configured to function as a hanger;

a tie back seal stem on a distal end of the cementation assembly configured to engage a liner hanger of a liner string;

a latching feature downhole of the expandable liner top packer and configured to expand and latch to a corresponding latching feature of the liner string to facilitate translation of motion of the cementation assembly to the liner string; and a running tool disposed within the expandable liner top packer configured to facilitate flow of cement from uphole drill pipe to the liner string.

8. The cementation system of claim 7, comprising the uphole drill pipe and the liner string, wherein the drill pipe is coupled to the cementation assembly and the liner string is coupled to the cementation assembly such that movement of the drill pipe is translated to the liner string.

9. The cementation system of claim 7, wherein the latching feature comprises a mechanical latch or a hydraulic latch.

10. The cementation system of claim 7, wherein the latching feature comprises dogs configured to move outward to engage recesses in the liner string and a tubing segment configured to slide down adjacent the dogs after engagement of the dogs with the recesses to maintain positioning of the dogs within the recesses by preventing the dogs from moving inward.

11. The cementation system of claim 7, wherein the expandable liner top packer is configured to be actuated mechanically and/or hydraulically.

12. The cementation system of claim 7, the tie back seal stem being downhole of the expandable liner top packer.

13. A method of cementation assembly operation, comprising:

engaging a latch feature of the cementation assembly with a liner string positioned downhole such that movement of the cementation assembly will be translated to the liner string;

repositioning the cementation assembly such that a liner hanger of the liner string disengages from the parent casing;

rotating and reciprocating the cementation assembly such that the liner string is rotated and reciprocated;

flowing cement through the cementation assembly into the liner string; and activating an expandable liner top packer of the cementation assembly to engage a parent casing.

14. The method of claim 13, comprising receiving a drill pipe dart into a liner wiper plug of the cementation assembly and releasing the liner wiper plug from the cementation assembly.

15. The method of claim 13, further comprising:

passing a drill pipe dart (DPD) through a drill pipe into engagement with a liner wiper plug (LWP) of the cementation assembly such that the DPD and LWP form a DPD/LWP assembly;

passing the DPD/LWP assembly through the liner string; and engaging a capture feature of the liner string with the DPD/LWP assembly such that an isolation mechanism is established.

16. The method of claim 13, wherein engaging the latch feature of the cementation assembly includes passing the latch feature through the liner hanger and expanding the latch feature into at least one recess in the liner string.

17. The method of claim 16, wherein expanding the latch feature into the at least one recess includes moving a tubing segment over the latch feature to hold dogs of the latch feature in the at least one recess in the liner string.

* * * * *